United States Patent [19]

Watanabe et al.

[11] Patent Number: 5,033,980

[45] Date of Patent: Jul. 23, 1991

[54] ELECTRICAL CONNECTOR WITH A DOUBLE LOCKING STRUCTURE FOR TERMINALS

[75] Inventors: Hiroshi Watanabe; Toshiaki Hasegawa, both of Shizuoka; Katsuaki Terada, Kosai, all of Japan

[73] Assignee: Yazaki Corporation, Tokyo, Japan

[21] Appl. No.: 515,995

[22] Filed: Apr. 27, 1990

[30] Foreign Application Priority Data

May 25, 1989 [JP] Japan ..... 1-130095

[51] Int. Cl.[5] ..... H01R 13/436

[52] U.S. Cl. ..... 439/595; 439/752

[58] Field of Search ..... 439/595, 752

[56] References Cited

U.S. PATENT DOCUMENTS

| | | | |
|---|---|---|---|
| 3,573,720 | 4/1971 | Reynolds | 339/217 |
| 3,686,619 | 8/1972 | McCardell, Jr. et al. | 439/595 |
| 4,319,799 | 3/1982 | Pearce, Jr. | 439/752 |
| 4,557,542 | 12/1985 | Coller et al. | 339/59 |
| 4,565,416 | 1/1986 | Rudy et al. | 339/59 |
| 4,621,883 | 11/1986 | Noguchi | 439/752 |
| 4,655,525 | 4/1987 | Hunt, III et al. | 339/63 |
| 4,714,437 | 12/1987 | Dyki | 439/595 |
| 4,721,478 | 1/1988 | Sonobe | 439/752 |
| 4,787,864 | 11/1988 | Hunt, III et al. | 439/595 |
| 4,820,198 | 4/1989 | Lulko et al. | 439/595 |
| 4,915,654 | 4/1990 | Zinn | 439/595 |
| 4,959,023 | 9/1990 | Watanabe et al. | 439/595 |

*Primary Examiner*—Gary F. Paumen
*Assistant Examiner*—Kevin J. Carroll
*Attorney, Agent, or Firm*—Armstrong, Nikaido, Marmelstein, Kubovcik & Murray

[57] ABSTRACT

A connector housing has a pair of opposing inner walls in which is formed a plurality of terminal accommodating cavities. One of the inner walls is formed with a first terminal locking portion and the other inner wall is formed with an opening or window communicating with the cavity inside the walls. A terminal locking member is attached to the inner walls, and its terminal locking plate is installed in the window so that it can be moved sideways across the cavities in two steps, i.e., to the preliminary locked position and to the full locked position. The terminal locking plate has a second terminal locking portion or projections spaced at certain intervals. When the terminal locking member is in the preliminary locked position, the terminal can be inserted into or removed from the cavity, with an engagement piece of the terminal passing through the gap between the projections of the terminal locking plate. As the terminal is fully inserted into the cavity, the first locking portion automatically engages the terminal, effecting the first locking. Then as the locking member is slid laterally across the cavities to the fully locked position, the projections or the second terminal locking portion come directly behind the engagement piece, thus providing a second locking.

2 Claims, 4 Drawing Sheets

ELECTRICAL CONNECTOR WITH A DOUBLE LOCKING STRUCTURE FOR TERMINALS

BACKGROUND OF THE INVENTION

1. Field of the Invention

The present invention relates to an electrical connector that has a double locking structure for terminals.

2. Description of the Relevant Art

With wiring harnesses or electrical connectors used for making connection in electric equipment, a structure as shown in FIG. 7 (U.S. Pat. No. 3,686,619) is available for preventing terminals from slipping off. In this structure, an insulating housing a is formed with a terminal accommodating cavity b, in which a flexible arm c with a projection d is provided. The projection d in the interior of the housing a is engaged with a small-diameter portion f of terminal e. A lock plate h is inserted into a slot g formed in the insulating housing a to prevent the flexible arm c from deflecting. If the terminal e is not completely inserted, the lock plate h cannot be inserted. Or if the lock plate h is inserted before the terminal e is inserted, the terminal e cannot be inserted or positioned in place. In either case, incomplete terminal insertion can be prevented. The sizes of the terminal e and the terminal accommodating cavity b are becoming smaller. In recent years, the above-mentioned size restrictions reduce the depth of engagement between the projection d and the terminal e and therefore, the terminal retaining force. So, when a strong pull is applied to the wire i, the terminal e may easily get pulled out.

In light of the above problems, this invention has been accomplished to provide an electrical connector that has a double locking structure for terminals and which offers an increased terminal retaining force to prevent dislocation of the terminal.

SUMMARY OF THE INVENTION

In order to achieve the above objective, the electrical connector according to this invention includes a connector housing having: a pair of opposing inner walls, a plurality of cavities defined by the inner walls for accommodating the terminals, a first locking portion formed on one of the opposing inner walls for engaging the terminal inserted at a correct position in the cavity, and a window formed in the other inner wall facing the first locking portion. The window communicates with the terminal accommodating cavities. The electrical connector further includes a terminal having: a base plate, an electric contact portion at the front part of the base plate for connection with a counterpart terminal, a wire connecting portion at the rear part of the base plate, and an engagement piece formed at one side of the base plate and projecting toward the window. The electrical connector further includes a terminal locking member mounted to the opposing inner walls in such a way that it can be moved to a preliminary locked position and to a full locked position in two steps across the terminal accommodating cavities. The terminal locking member has a terminal locking plate, and the terminal locking plate has on the inner surface thereof a second locking portion which is engageable with a rear end of the engagement piece of the terminal when the terminal is completely inserted and the terminal locking member is pushed to the full locked position.

In the electrical connectors of this invention, the second locking portion of the terminal locking plate in the terminal locking member, which can be slid sideways, is engaged with the engagement piece formed on the base plate of the terminal to effect the second locking of the terminal.

In order that the terminal locking member can be moved across the cavities, a window is formed in the inner wall of the connector housing in such a way as to communicate with the terminal accommodating cavities. Through this opened window, the second locking portion that engages the engagement piece of the terminal is projected into the cavity.

With this construction, the depth of engagement between the terminal and the terminal locking member is increased, thereby reinforcing the terminal retaining force and preventing the terminal from becoming dislocated or pulled out accidentally.

DESCRIPTION OF THE PREFERRED EMBODIMENT

Figure 1:
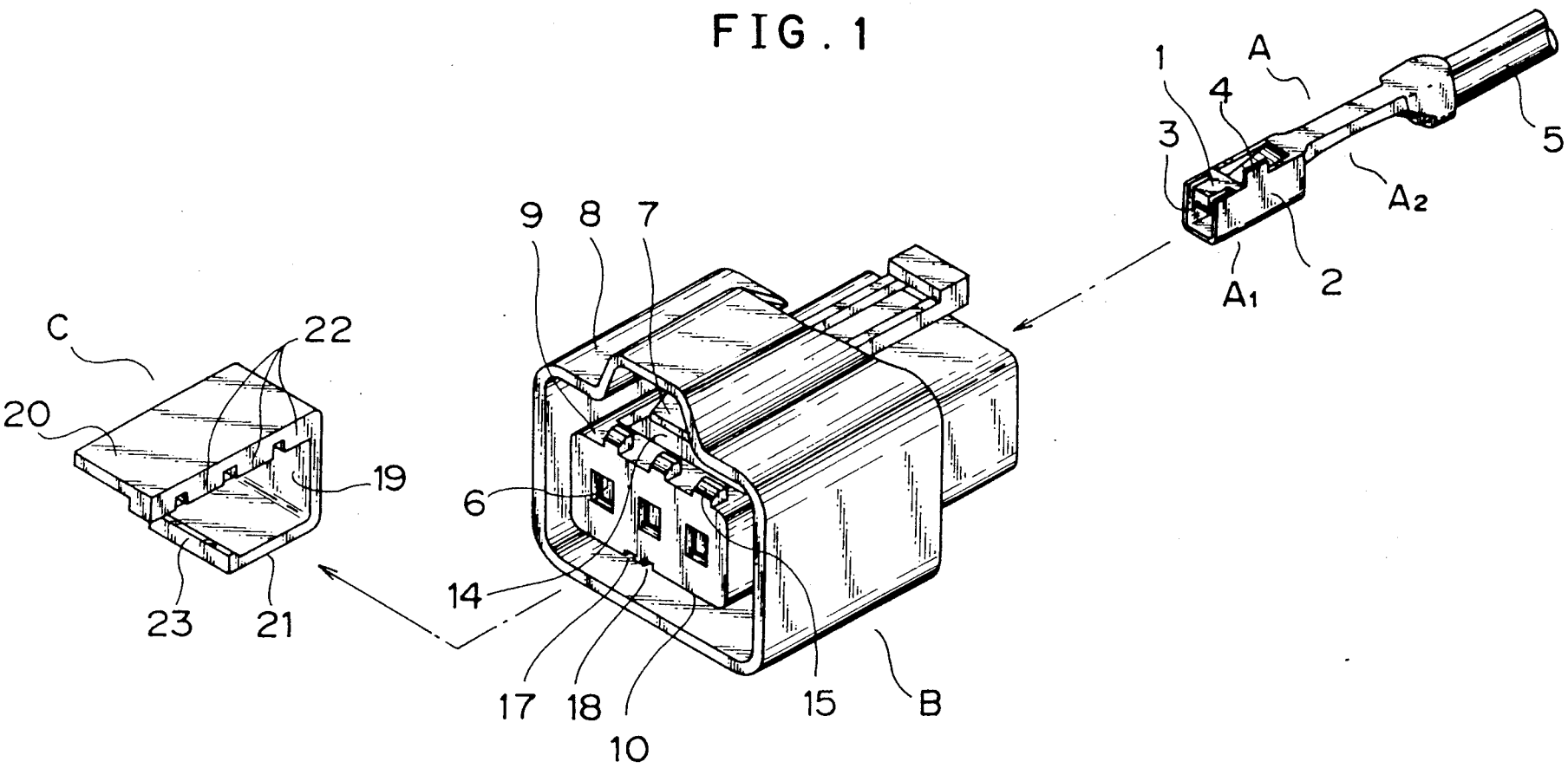
FIG. 1 is an exploded perspective view of an electrical connector of this invention.
Figure 2:
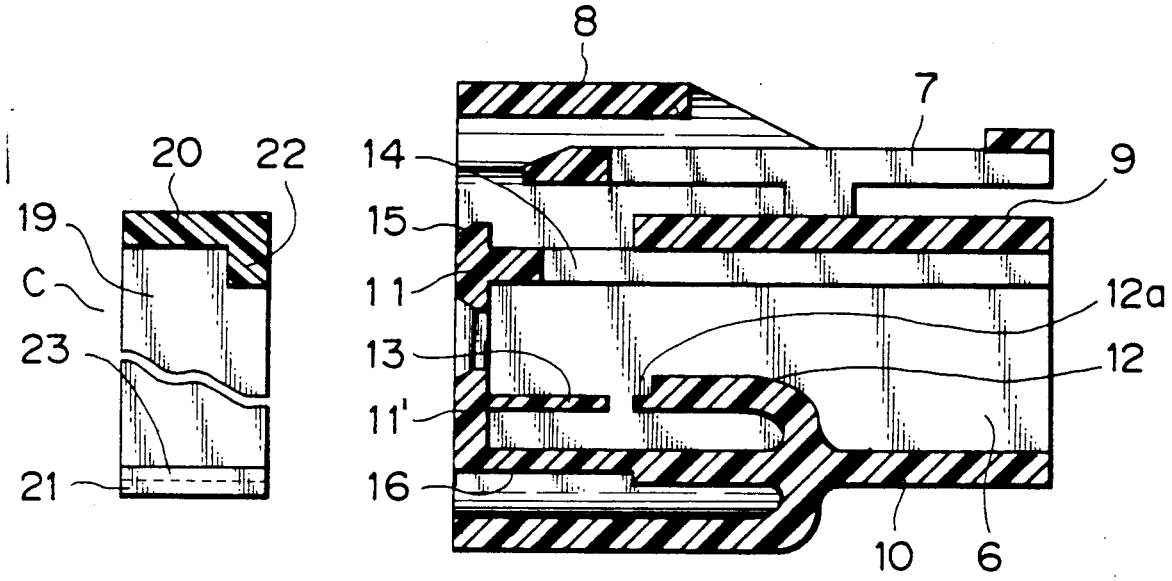
FIG. 2 is a cross section showing the connector housing and the terminal locking member of FIG. 1 disengaged.

Referring to FIGS. 1 and 2, reference symbol A represents a female terminal made of a thin sheet metal, B a male connector housing made of synthetic resin; and C a terminal locking member of synthetic resin mounted on one end of the connector housing. The connector housing B is adapted to engage a counterpart female connector housing (not shown).

The terminal A has at the front part of a base plate 1 an electrical contact portion $A_1$ and, at the rear portion thereof, a wire connecting portion $A_2$, to which a wire 5 is crimped. The electrical contact portion $A_1$ comprises a square cylinder receptor portion 2 and a resilient tongue piece 3, these two members cooperating to receive and snugly grip a tab portion of the male terminal not shown. The base plate 1 has an engagement piece 4 at one side thereof that projects in a direction opposite to that in which the receptor portion 2 projects.

Inside the connector housing B are provided a plurality of terminal accommodating cavities 6 arranged laterally in a single row, the terminal accommodating cavities 6 adapted to receive contacts of the counterpart female connector housing at a mating face of connector housing B. On the outer front half of the housing B there is a resilient locking arm 7 that will lock the mating female connector housing, and a water-proofing hood 8. A top inner wall 9 and a bottom inner wall 10 of the connector housing B constitute opposing top wall 9 and bottom wall 10 of the cavities 6.

Each of the terminal accommodating cavities 6 is opened at both ends. At the front open end of each cavity 6, there are formed upper and lower stopper walls 11, 11' for the terminal A. At the center of the inner surface of the bottom wall 10, a resilient arm 12 is projected toward the front open end of the cavity 6. A play prevention wall 13 is projected from the lower stopper wall 11' and extends backwardly toward the arm 12 so that they face each other in a close relationship.

The terminal locking member C is formed like a letter U lying on its side in cross section and consists of a vertical side plate 19, a terminal locking plate 20 and a housing lock plate 21, the latter two projecting horizontally and in parallel from the upper and lower edges of the side plate 19. The terminal locking plate 20 is almost equal in length to the width of the connector housing B, and has a plurality of gaps 22 formed on the inner surface thereof at certain intervals that receive the engagement piece 4 of the female terminal A. The projections 22 of the terminal locking plate 20 are positioned diagonally rearward from the respective engagement pieces 4 when the terminal locking member C is in a preliminary locked condition. When it is in a fully locked state, the projections 22 are immediately behind the engagement pieces 4.

The housing lock plate 21 is sufficiently short in length with respect to the width of the connector housing B and, at its free end, has a locking claw 23 projecting upward. The top inner wall 9 of the connector housing B which opposes the flexible arm 12 is formed with a window or opening 14, which extends in a direction crossing the plural cavities 6 so as to receive the terminal locking plate 20. On the upper stopper wall 11 in front of the window 14 is formed a retraction prevention projection 15 that prevents the terminal locking plate 20 from being pulled back.

The bottom inner wall 10 is formed with guide grooves 16 for accepting the housing lock plate 21. The guide grooves 16 consist of a preliminary lock groove 17 and a full lock groove 18. (See FIG. 6.) The flexible arm 12 in the cavity 6 and the projections 22 of the terminal locking member C constitute a first and a second locking portion.

Next, the double locking of the terminal A offered by the terminal locking member C will be explained by referring to FIGS. 3 to 6.

Figure 3:
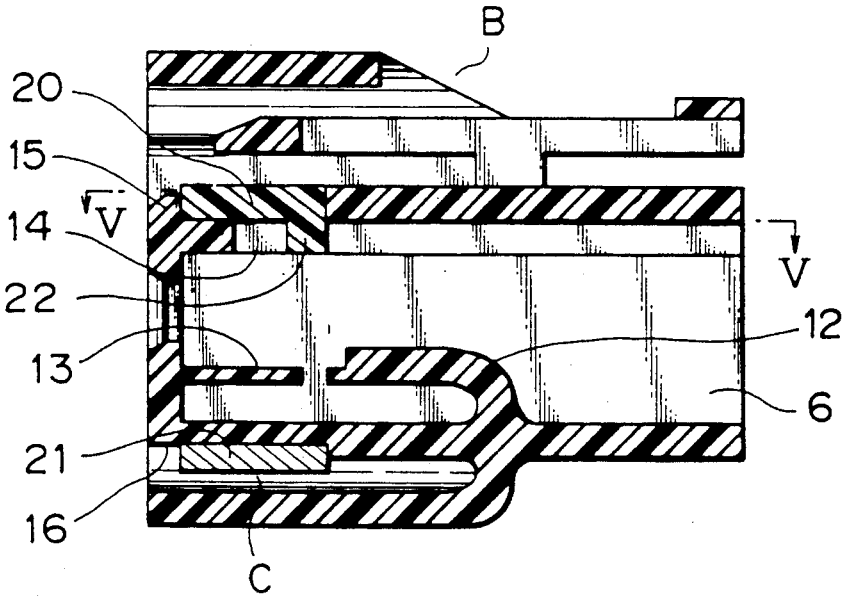
FIG. 3 is a cross section showing the connector housing and the terminal locking member of FIG. 1 in a preliminary locked condition.
Figure 5:
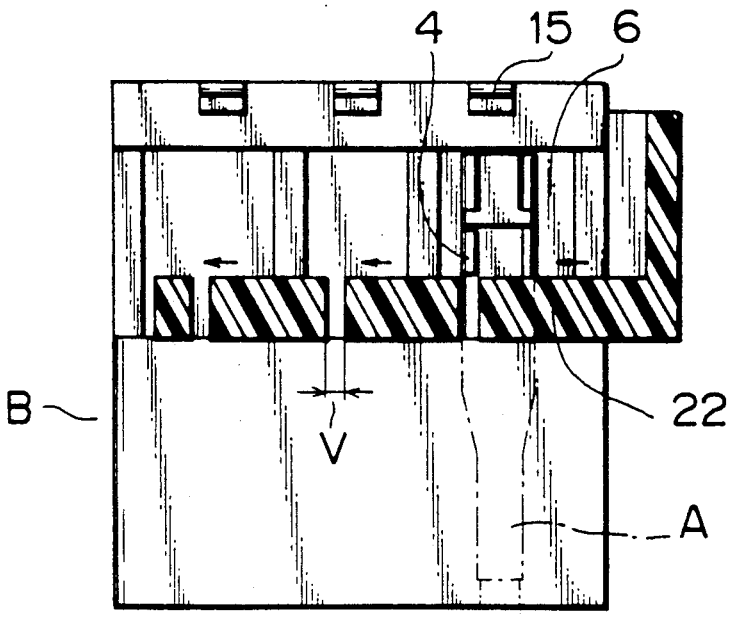
FIG. 5 is a cross section taken along the line V—V of FIG. 3.
Figure 6:
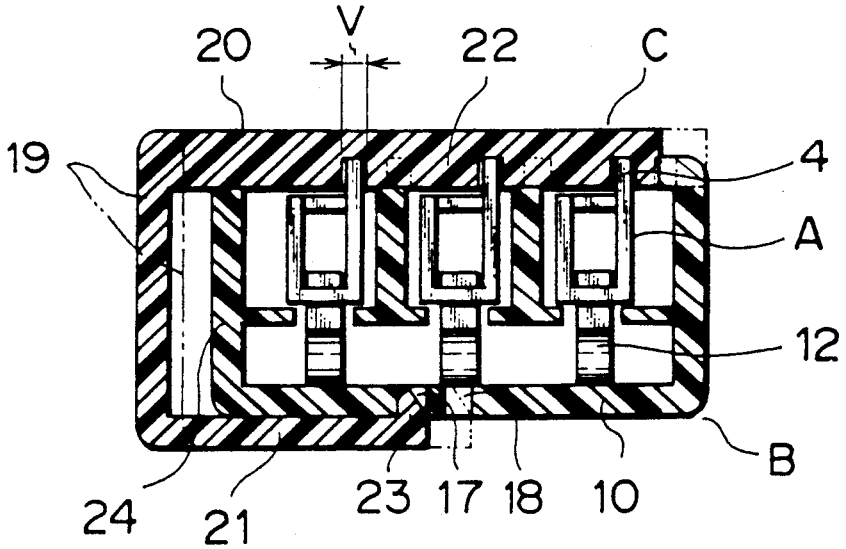
FIG. 6 is a cross section taken along the line VI—VI of FIG. 4.
Figure 7:
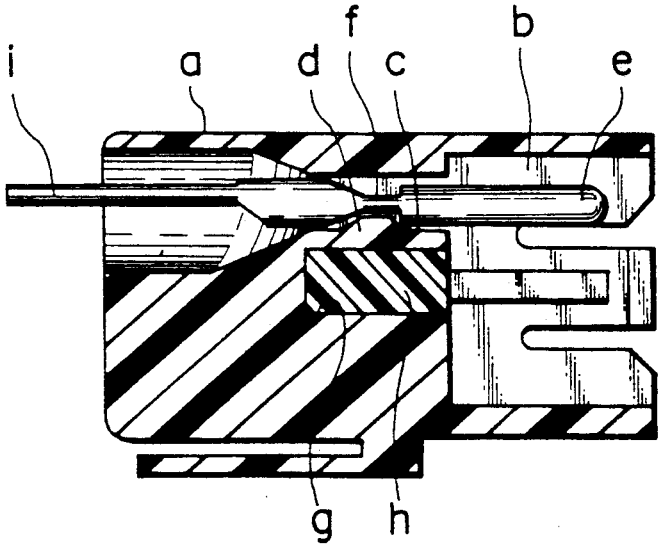
FIG. 7 PRIOR ART
FIG. 7 is a cross section of the conventional electric connector showing the terminal locking structure.

Before the terminal A is inserted, the connector housing B and the terminal locking member C are in the preliminary locked condition, as shown in FIGS. 3, 5 and 6. The terminal locking member C, which is mounted from the same direction that the counterpart mating female connector housing is sleeved over (mated to) the male connector housing B in a mating direction, has its terminal locking plate 20 engaged in the window 14, and its housing lock plate 21 engaged with the guide groove 16. In more detail, the terminal locking plate 20 is blocked by the retraction prevention projection 15 from being pulled back to the front side, and the locking claw 23 is engaged with the preliminary lock groove 17 (as indicated by the solid line of FIG. 6).

At this time, the projections 22 of the terminal locking plate 20, as shown in FIG. 5, are positioned to one side of each cavity 6 (to the right in the figure) to leave a gap V that will allow the passage of the engagement piece 4 of the terminal A.

Figure 4:
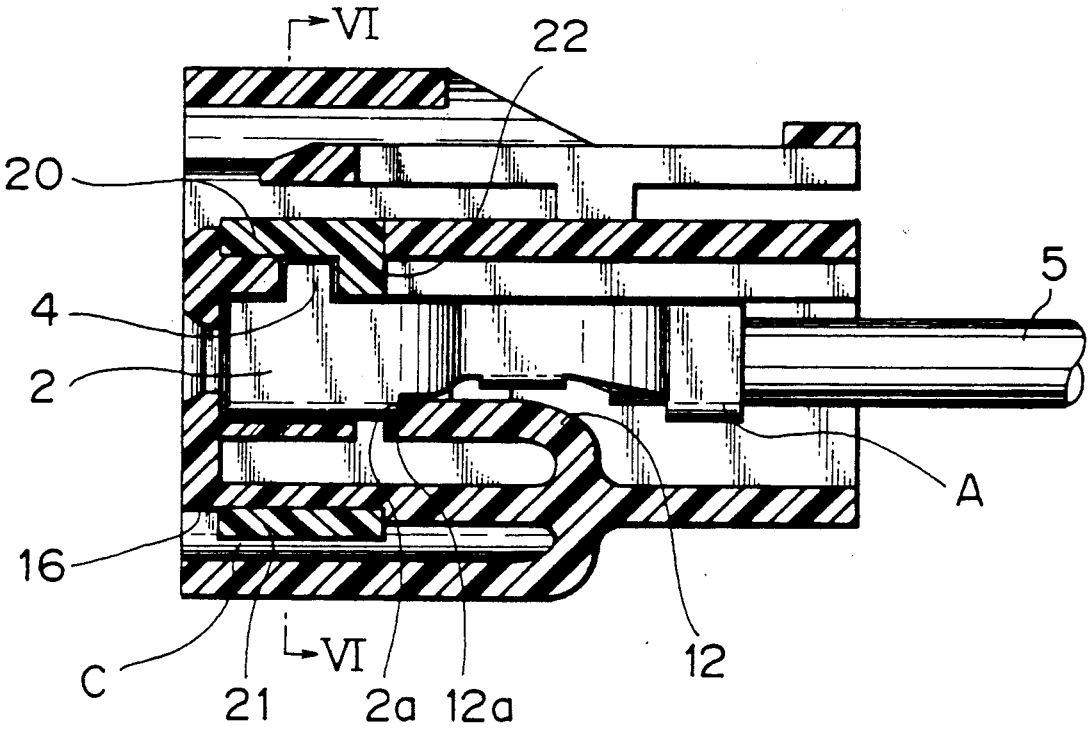
FIG. 4 is a cross section showing the connector housing and the terminal locking member of FIG. 3 in a fully locked condition.

In this preliminary locked condition, the terminal A attached to the wire 5 is inserted into the corresponding cavity 6 from the rear open end thereof until the terminal A reaches the complete insertion position, at which time, as shown in FIG. 4, the engagement step **12*a* of the flexible arm 12 engages the rear shoulder portion 2*a* of the receptor portion 2**, thus effecting the first locking.

Then, as the terminal locking member C is slid in the direction the arrows of FIG. 5 (i.e., in a direction not parallel to the above-mentioned mating direction), the projections 22 move to the positions immediately behind the engagement pieces 4 of the terminals A, as indicated by two-dot line of FIG. 6, thus effecting the second locking. At the same time, the locking claw 23 of the housing lock plate 21 engages the full lock groove 18 of the bottom inner wall 10 of the housing B, bringing the terminal locking member C and the connector housing B into the fully locked state. The side plate 19 of the terminal locking member C comes into contact with the end wall 24 of the connector housing B, thus serving as a stopper.

It is easily understood from FIG. 5 that when the terminal A is not completely inserted, the projections 22 contact the sides of the engagement pieces 4, which blocks the terminal locking member C from being pushed and slid inwardly to the fully locked position. Therefore, the manipulation of the terminal locking member C permits the checking for any incomplete insertion of the terminal.

While in the above embodiment the housing lock plate 21 of the terminal locking member C is formed separate from the terminal locking plate 20 with the side plate 19 interconnecting them, the locking claw 23 for the connector housing B may be provided to the terminal locking plate 20. Where the cavities 6 in the connector housing B are arranged in two tiers, an additional housing lock plate 21 may be provided and, at the inner surface, it may also be formed with projections 22.

It should be noted that the terminal A is not limited to the female type but is also applicable to the male type. In general, this invention can be applied to the electrical connectors with a construction in which there is a first locking means (shoulder portion **2*a* and resilient arm 12) between the terminal and the cavity and also, a second locking means (engagement piece 4 and terminal locking plate 20**) between the terminal and the terminal locking member.

In summary, the electrical connector according to this invention has the following advantages. Since the double locking of the terminal is achieved by the member (terminal locking member) mounted on the peripheral portion of the connector housing, the terminal locking is not greatly affected by the size of terminals and cavities. This construction increases the terminal retaining force and eliminates accidental removal of terminals.

Moreover, since the terminal is doubly locked by laterally moving the terminal locking member from the preliminary locked condition to the full locked condition, any incomplete insertion of the terminal can be checked and prevented. While the invention has been particularly shown and described in reference to preferred embodiments thereof, it will be understood by those skilled in the art that changes in form and details may be made therein without departing from the spirit and scope of the invention.

What is claimed is:

1. An electrical connector with a double locking structure for terminals, comprising:

a connector housing having:

a pair of opposing inner walls, a plurality of cavities defined by the inner walls for accommodating the terminals, a first locking portion formed on one of said opposing inner walls for engaging the terminal inserted at a correct position in the cavity, and a window formed in the other inner wall facing the first locking portion, said window communicating with the terminal accommodating cavities;

a terminal having:

a base plate having a front portion and a rear portion, an electric contact portion at the front portion of the base plate for connection with a counterpart terminal, a wire connecting portion at the rear portion of the base plate, and an engagement piece formed at one side of the base plate and projecting toward the window; and a terminal locking member having an inner surface mounted and locked to the opposing inner walls at a mating face of the housing before insertion of the terminal in such a way that the terminal locking member can be moved to a preliminary locked position in a first direction and to a full locked position in a second direction non-parallel to the first direction in two steps across the terminal accommodating cavities, said terminal locking member having a terminal locking plate with an inner surface, said terminal locking plate having an outer surface thereof which is engageable with the engagement piece of the terminal to block the terminal from being inserted to the full locked position, said terminal locking plate having on the inner surface thereof a second locking portion which is engageable with a rear end of the engagement piece of the terminal when the terminal is completely inserted and the terminal locking member is pushed to the full locked position.

2. An electrical connector as set forth in claim 1, wherein a plurality of the second locking portions are provided on the inner surface of the terminal locking plate at certain intervals and, when the terminal locking member is in the preliminary locked position, the engagement piece of the terminal can be advanced and retracted through a gap between the second locking portions.

* * * * *